US006742489B2

(12) United States Patent
Vichinsky

(10) Patent No.: US 6,742,489 B2
(45) Date of Patent: Jun. 1, 2004

(54) INTAKE MANIFOLD FOR INTERNAL COMBUSTION ENGINE WITH INTEGRATED FUEL RAIL

(75) Inventor: Kevin Vichinsky, Portage, MI (US)

(73) Assignee: Filterwerk Mann & Hummel GmbH, Ludwigsburg (DE)

( * ) Notice: Subject to any disclaimer, the term of this patent is extended or adjusted under 35 U.S.C. 154(b) by 60 days.

(21) Appl. No.: 10/244,544

(22) Filed: Sep. 17, 2002

(65) Prior Publication Data

US 2003/0051693 A1 Mar. 20, 2003

Related U.S. Application Data

(60) Provisional application No. 60/323,072, filed on Sep. 19, 2001.

(51) Int. Cl.[7] ..... F02M 35/10; F02M 55/02

(52) U.S. Cl. ..... 123/184.21; 123/468

(58) Field of Search ..... 123/184.21, 456, 123/468, 469

(56) References Cited

U.S. PATENT DOCUMENTS 5,022,371 A * 6/1991 Daly ..... 123/468

* cited by examiner

*Primary Examiner*—Noah P. Kamen
(74) *Attorney, Agent, or Firm*—Crowell & Moring LLP

(57) ABSTRACT

A combined air intake manifold and fuel delivery rail for an internal combustion engine which decreases manufacturing and assembly costs, as well as the weight of the engine. An air channel formed in a hollow portion of the manifold registers with air intake ports in the engine head which lead to the individual cylinders of the engine. An elongated recess in the underside of a mounting flange forms a fuel supply channel which communicates with fuel inlet openings in the engine head leading to fuel injectors for the engine cylinders. Seals may be provided between the manifold and the engine head to seal the air channel and the fuel supply channel.

4 Claims, 5 Drawing Sheets

INTAKE MANIFOLD FOR INTERNAL COMBUSTION ENGINE WITH INTEGRATED FUEL RAIL

BACKGROUND OF THE INVENTION

Conventional internal combustion engines are provided with an intake manifold through which combustion air is supplied to the engine. Conventional engines are also provided with a separate fuel rail through which fuel is supplied to the individual cylinders. The provision of separate elements not only increases the manufacturing expense for the individual parts, but also the assembly costs because two separate elements must be individually mounted to the engine. In addition, the provision of two separate parts increases the overall weight of the engine.

SUMMARY OF THE INVENTION

The present invention provides a combined or integrated air intake manifold and fuel rail for an internal combustion engine. The device of the invention has the specific advantages of lower manufacturing costs because only a single part needs to be produced, lower assembly costs because only a single part needs to be attached to the engine during assembly, and lower overall weight. In addition, the sealing of the intake manifold and fuel supply is simplified because a single seal can be used for both elements. The invention comprises a molded intake manifold body which defines an air channel for supplying combustion air to air intake ports of individual cylinders of an internal combustion engine. The manifold body is provided with mounting flanges by which it is secured to the head of an engine by mounting bolts. In the mounting face of one of the flanges of the intake manifold, an elongated recess is formed. This recess is arranged to register with fuel delivery holes in the engine head which lead to fuel injectors for the individual cylinders. The intake manifold is mounted with the mating surfaces of the flanges against a surface of the engine head. One of the mounting flanges of the intake manifold is disposed so that it covers an array of individual fuel delivery holes, which in turn lead to fuel injectors for the individual cylinders. When the intake manifold is mounted against the mounting surface on the engine head, the recess in the mounting surface on the manifold and the mounting surface of the head together form a closed channel which serves as a fuel delivery channel. Fuel is supplied to the recess in the bottom of the intake manifold flange for distribution through the fuel delivery holes to the individual fuel injectors. The fuel supply may be accomplished by connecting a fuel line leading from a fuel pump to a connecting stem on the intake manifold. The connecting stem is preferably provided on its outer diameter with annular ribs which serve to hold the fuel line on the stem. A bore is formed through the center of the stem and extended through the manifold flange until it opens into the aforementioned recess in the mounting surface of the intake manifold.

If the intake manifold is made of a material with sufficient plasticity or resilience, it may be self sealing against the engine head. Alternatively, however, a separate seal member may be provided between the intake manifold and the engine head. If desired, recesses may be formed in the mating surface of the intake manifold to accommodate such seals.

The integrated intake manifold and fuel rail of the present invention may be manufactured by any suitable method. For example, it could be machined from a solid block of material. It is preferred, however, for economic reasons to form the integrated intake manifold and fuel rail by casting or molding. The manifold may be made of any suitable material such as metals, e.g., cast iron, aluminum or titanium, or synthetic resins, e.g., polyamides such as nigh strength nylon 6 or nylon 6-6 polymers.

BRIEF DESCRIPTION OF THE DRAWINGS

The invention will be described in further detail hereinafter with reference to an illustrative preferred embodiment shown in the accompanying drawings in which.

DETAILED DESCRIPTION OF PREFERRED EMBODIMENTS

Figure 1:
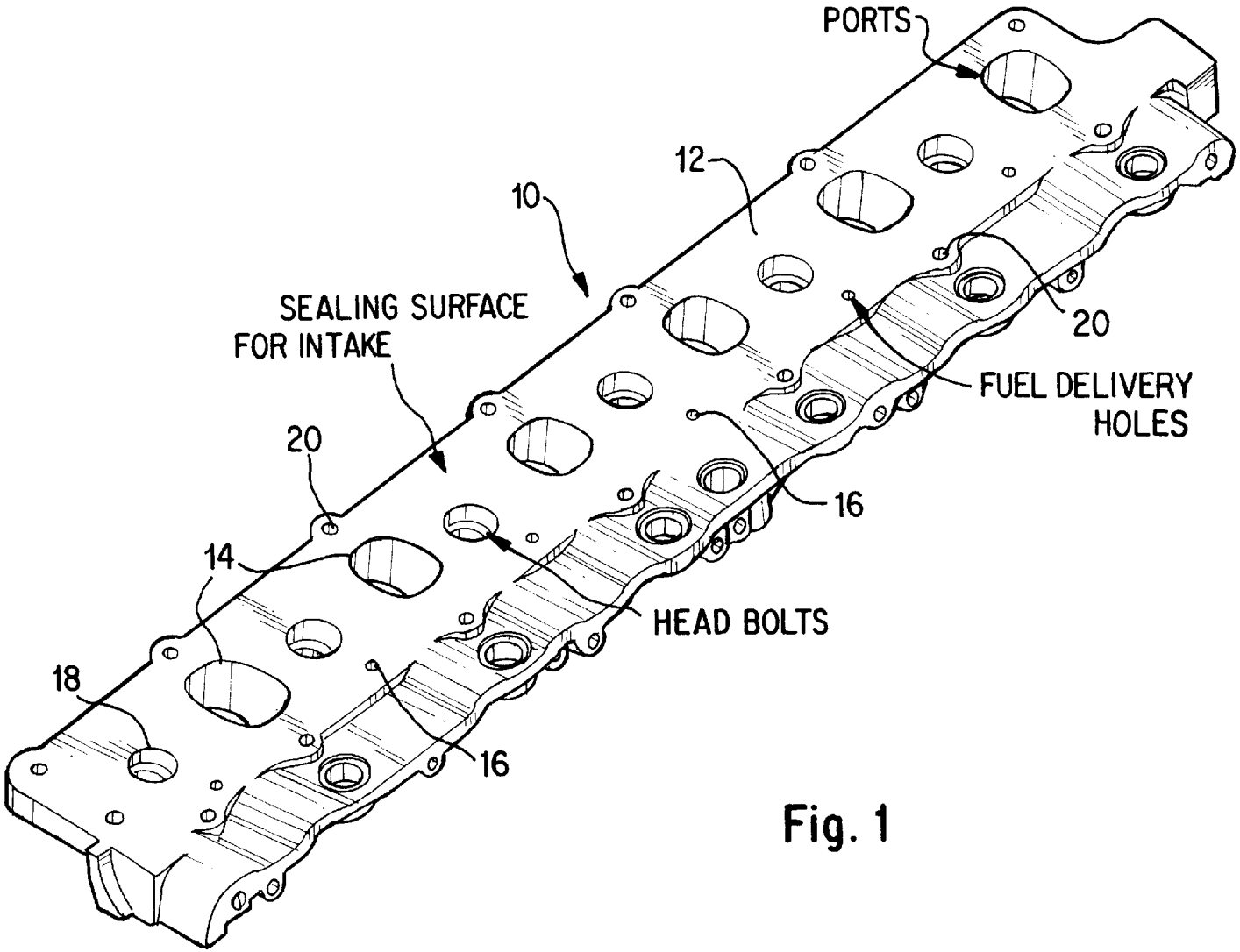
FIG. 1 is a perspective view of an engine head capable of accommodating the integrated air intake manifold and fuel delivery rail of the present invention.

FIG. 1 is a perspective view of an engine head 10 designed to accommodate an integrated air intake manifold and fuel delivery rail according to the present invention. Engine head 10 is provided with a flat sealing surface 12 on which the air intake manifold and fuel rail are mounted. Surface 12 includes a plurality of air intake ports 14 through which air is conveyed to the individual cylinders of the engine. In addition, surface 12 contains an array of fuel delivery holes 16 which lead to fuel injectors (not shown) for the individual cylinders of the engine. Apertures 18 are also provided for head bolts which secure the head to the rest of the engine block. Holes 20 are also provided to receive mounting bolts for the integrated air intake manifold and fuel rail.

Figure 2:
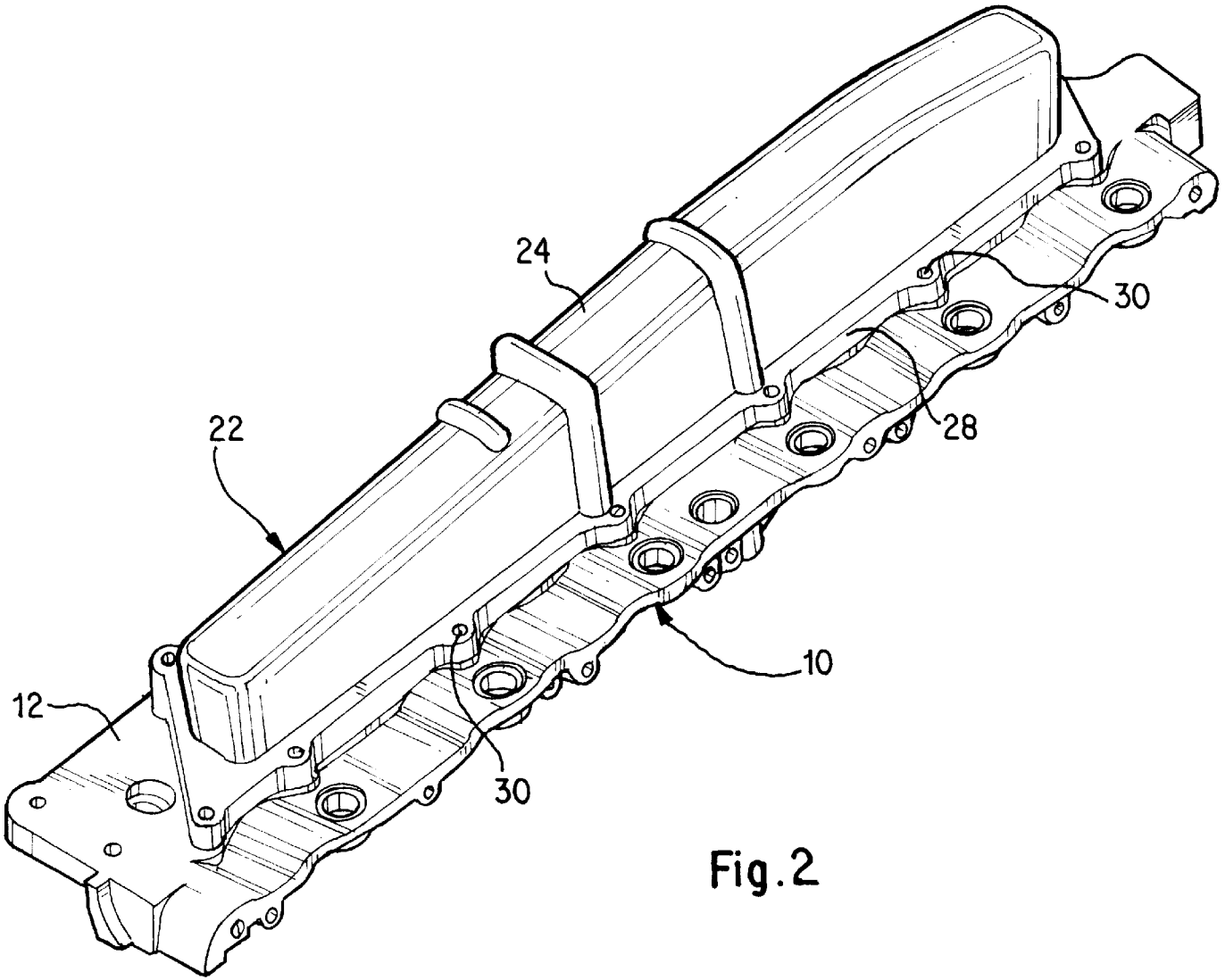
FIG. 2 is a perspective view of the engine head having an integrated air intake manifold and fuel rail according to the invention mounted thereon.

Turning now to FIG. 2, a combined air intake manifold and fuel rail 22 is shown attached to surface 12 of head 10. Manifold 22 comprises a hollow portion 24 defining a channel through which air is conducted to the air intake ports of the engine. Manifold 22 is also provided with a surrounding flange portion 28 by which it is mounted on head 10. A plurality of apertures 30 are formed around the periphery of flange 28 which serve to receive mounting bolts for the manifold assembly.

Figure 3:
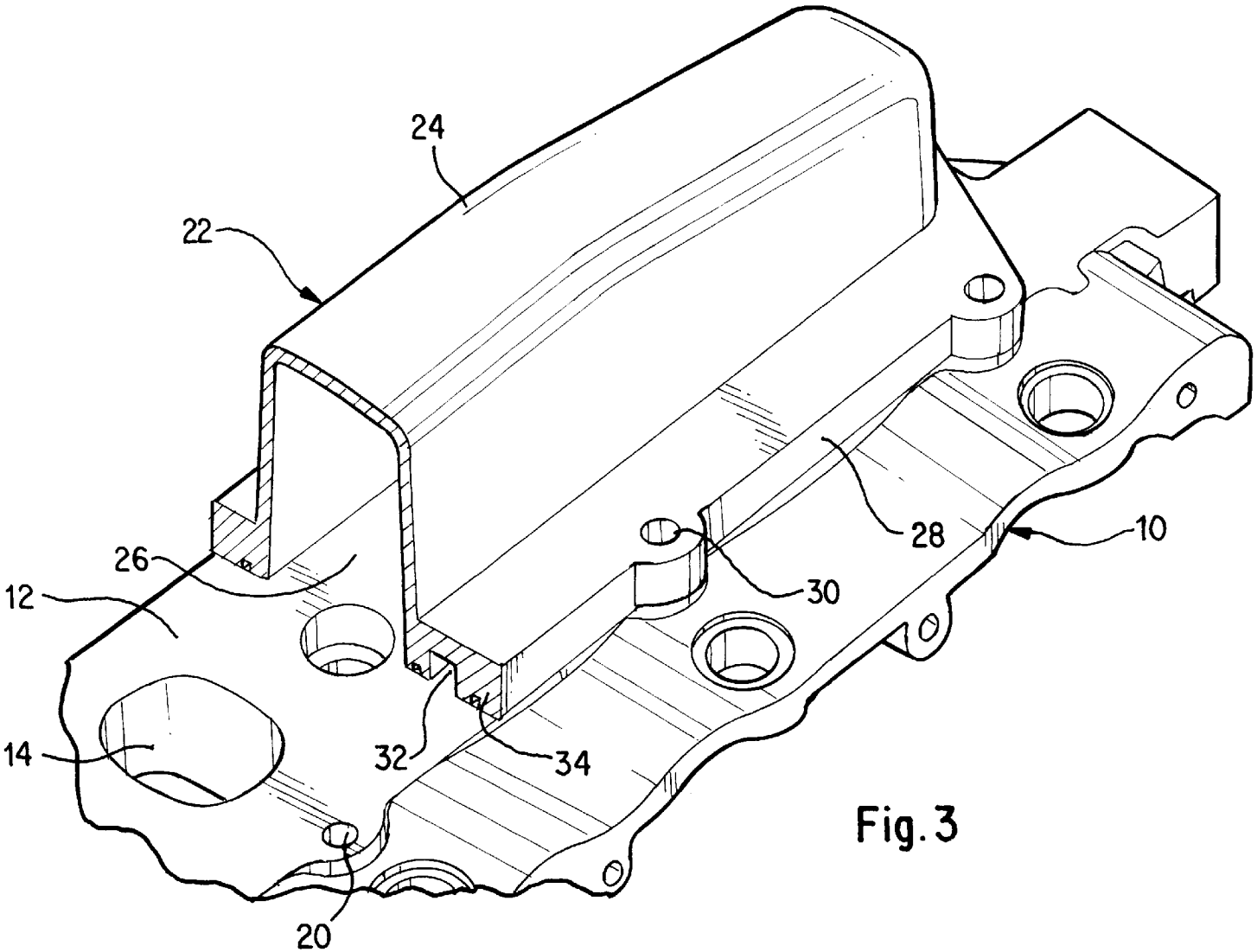
FIG. 3 is an enlarged view of a portion of the engine head and air intake manifold of FIG. 2 with the manifold partially cut away to reveal the integral fuel delivery channel.

As seen more clearly in the partially cut-away view of FIG. 3, hollow portion 24 of manifold 22 defines a channel 26 which registers with the air intake ports 14 in the engine head when manifold 22 is mounted on surface 12 of head 10. Air from an air filter (not shown) is conveyed through an air duct (also not shown) to an inlet (not shown) in hollow portion 24 communicating with air channel 26. The air introduced into channel 26 through the inlet port is conveyed through the channel to the air intake ports 14 leading to the individual cylinders. As can also be seen in the cut away end face 34 of manifold 22, a recess 32 is formed in the underside of flange 28. Recess 32 extends along the length of flange 28 and is arranged so that it registers with the array of fuel delivery holes 16 in surface 12. Recess 32 together with surface 12 of engine head 10 form a closed fuel duct through which fuel is conducted from a fuel pump through a fuel line (not shown) to the fuel delivery holes 16, and thence to the fuel injectors for the engine cylinders.

Figure 4:
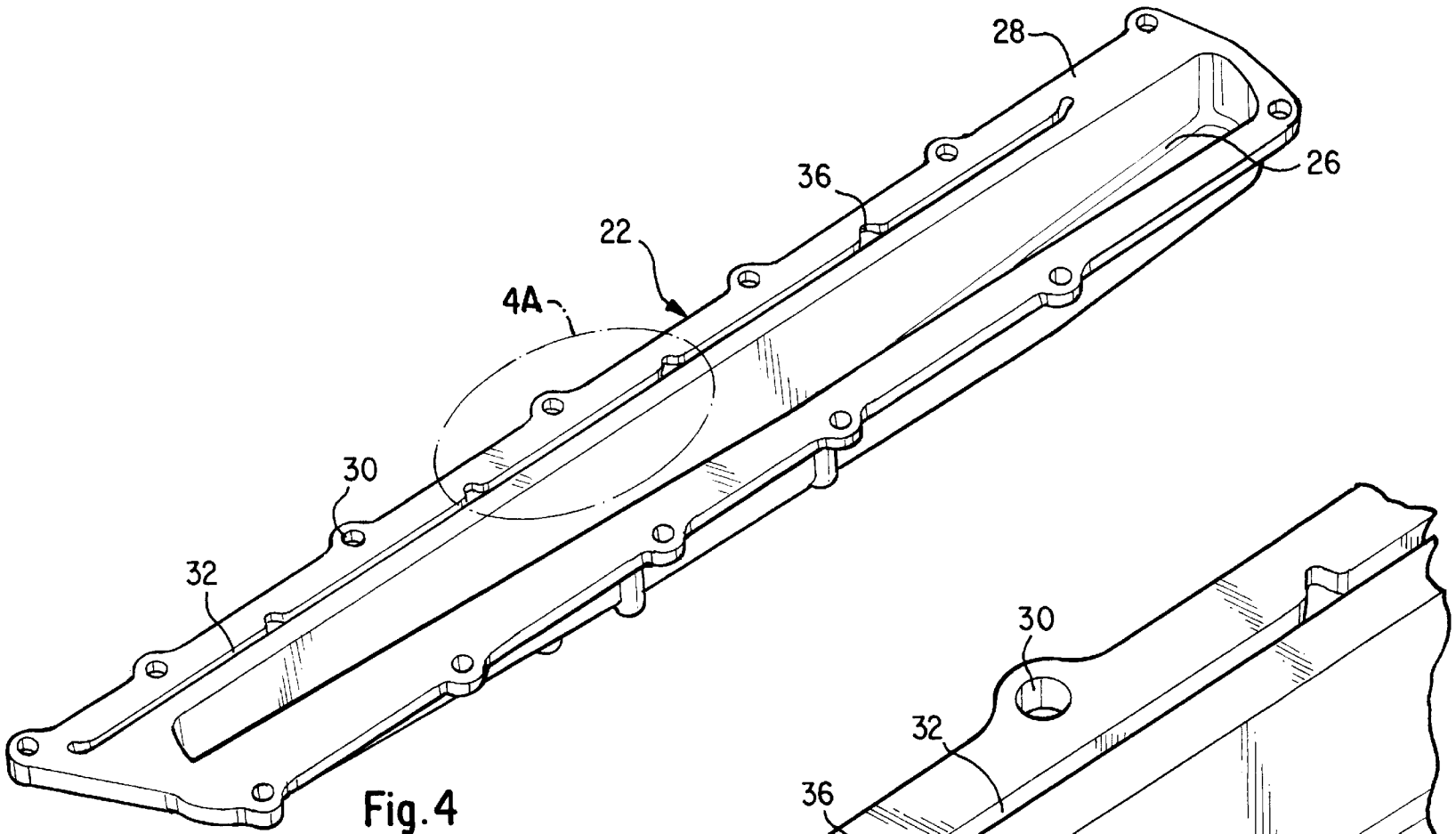
FIG. 4 is a bottom view of the integrated air intake manifold and fuel rail according to the present invention depicting the recess which forms the fuel delivery channel in the mounting face of the air intake manifold.
Figure 4A:
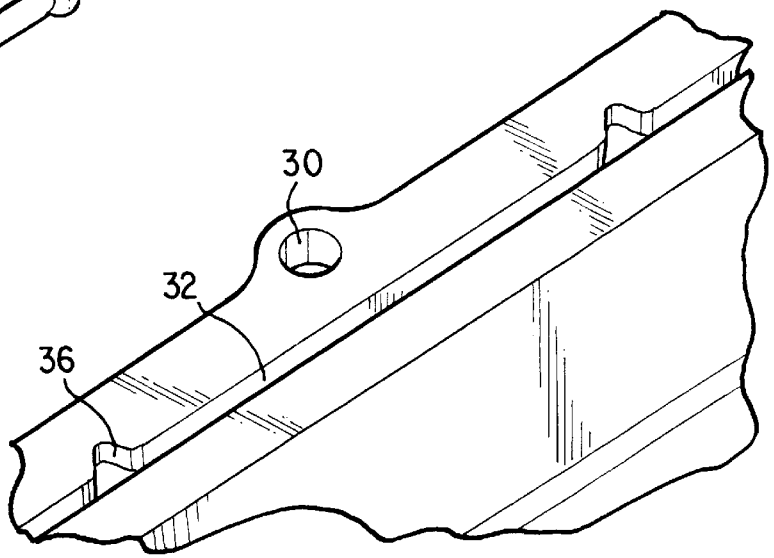

The full length of recess 32 can be seen in FIG. 4, which is a bottom perspective view of air intake manifold 22. As can be seen in the drawing, recess 32 extends along the underside of flange 28. Recess enlargements 36 are provided in recess 32 wherever the recess intersects one of the fuel delivery holes, so that proper registration of the recess with the fuel delivery holes will be assured, even if air intake manifold 22 is slightly misaligned during assembly to the engine head.

Figure 5:
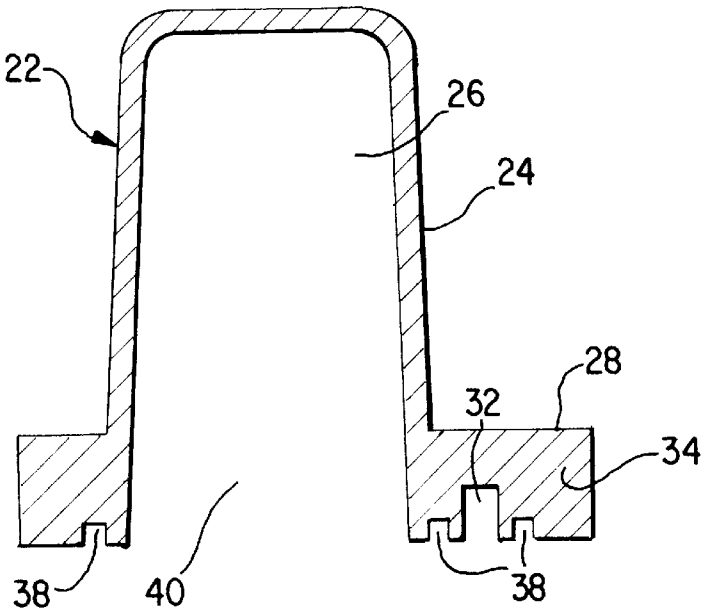
FIG. 5 is a cross sectional view of the integrated air intake manifold and fuel rail according to the present invention.

FIG. 5 is a sectional view through air intake manifold 22 with integrated fuel delivery channel 32. Again it can be seen how manifold 22 comprises a hollow portion 24, which defines an air intake channel 26 and a flange portion 28, in which recess 32 is formed. Open end 40 of channel 26 is superposed over the air intake ports 40 on surface 12 of engine head 10. If desired, recesses 38 may be provided in the underside of flange 28 to accommodate seals to assure that the integrated air intake and fuel rail device of the invention will not leak when mounted to surface 12 of engine head 10. Alternatively, a gasket type seal with openings registering with the open end 40 of air channel 26 and with recess 32 can be interposed between flange 28 and mounting surface 12 of engine head 10.

Figure 6:
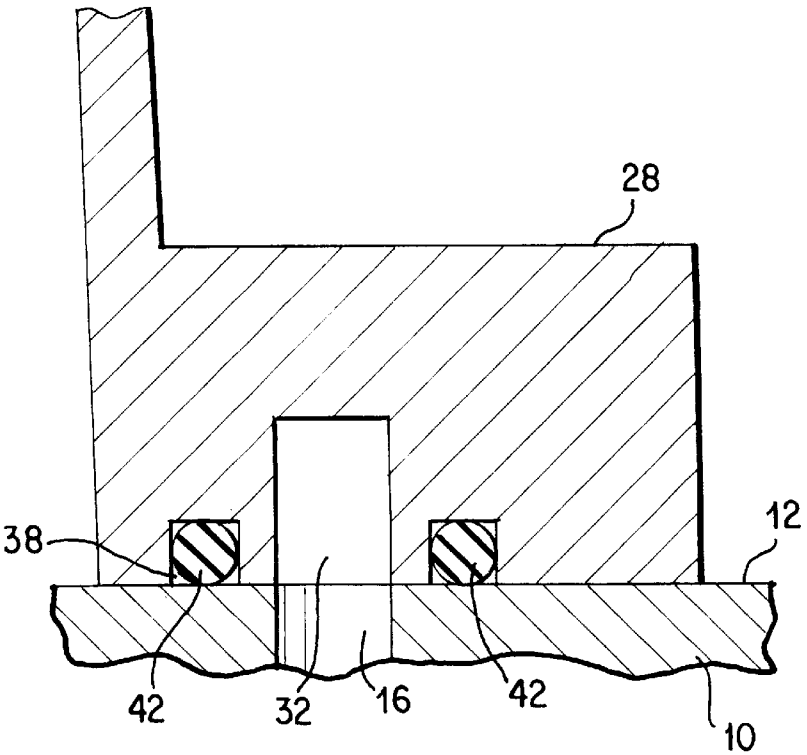
FIG. 6 is an enlarged view of the mounting flange of the intake manifold according to the invention showing the fuel delivery channel registering with the fuel delivery hole in the engine head.

FIG. 6 is an enlarged partial sectional view of flange 28 of air intake manifold 22. In this view, it can be seen how recess 32, which forms the fuel delivery channel registers with one of the fuel delivery holes 16 in engine head 10 so that fuel can pass from the fuel delivery channel formed by recess 32 through the fuel delivery hole 16 to a fuel injector of the engine. Also visible in FIG. 6 are resilient seal members 42 which are disposed in recesses 38 in the underside of flange 28 in order to assure proper sealing of the fuel delivery channel.

The foregoing description and examples have been set forth merely to illustrate the invention and are not intended to be limiting. Since modifications of the illustrated embodiments incorporating the spirit and substance of the invention may occur to persons skilled in the art, the invention should be construed broadly to include all variations falling within the scope of the appended claim and equivalents thereof.

What is claimed is:

1. A combined air intake manifold and fuel rail for an internal combustion engine comprising a hollow portion defining an air channel with an open face, and a mounting flange portion having a recess in an the underside thereof defining a fuel delivery channel, said manifold adapted to be installed on an engine head with the open face of the air intake channel positioned over a series of air intake ports and the fuel delivery channel overlying an array of fuel inlet openings in the engine head.

2. A combined air manifold and fuel rail according to claim 1, formed of molded synthetic resin material.

3. A combined air manifold and fuel rail according to claim 1, further comprising a seal member for sealing the manifold and fuel rail to the engine head when installed thereon.

4. A combined air manifold and fuel rail according to claim 1, wherein said recess comprises enlarged portions which register with the fuel inlet openings.

* * * * *